United States Patent [19]

Pastora Alice

[11] 4,276,830

[45] Jul. 7, 1981

[54] CARTRIDGE CASE

[76] Inventor: Julio C. Pastora Alice, c/3.-Av. 4-6 - No. 429, San Jose, Costa Rica

[21] Appl. No.: 29,509

[22] Filed: Apr. 12, 1979

[51] Int. Cl.[3] ..... F42B 5/26; F42B 7/06

[52] U.S. Cl. ..... 102/467; 102/469

[58] Field of Search ..... 102/38 R, 43 R, 43 P, 102/44 R

[56] References Cited

U.S. PATENT DOCUMENTS

| | | | |
|---|---|---|---|
| 2,972,947 | 2/1961 | Fitzsimmons et al. | 102/43 P |
| 3,424,089 | 1/1969 | Humpherson | 102/43 P |
| 4,132,173 | 1/1979 | Amuchastegui | 102/43 P |
| 4,147,107 | 4/1979 | Ringdal | 102/43 P |

FOREIGN PATENT DOCUMENTS

| | | | |
|---|---|---|---|
| 1961307 | 6/1971 | Fed. Rep. of Germany | 102/43 P |

*Primary Examiner*—Harold J. Tudor

*Attorney, Agent, or Firm*—Karl W. Flocks

[57] ABSTRACT

An improved cartridge case comprising an exterior plastic tubular member having an end on which is positioned one or more pieces of any type of material assembled and united or connected together with the plastic tube through plastic injection as a single member.

2 Claims, 24 Drawing Figures

CARTRIDGE CASE

FIELD OF THE INVENTION

This invention relates to cartridge cases and in particular one which essentially includes an exterior plastic tube with one or several pieces of the same or different type of materials at one of their tips, duly assembled and positioned with the tube and the rest of the assembly connected or united by an injection of plastic material forming a monobloc or one-piece assembly.

PRIOR ART

There are available on the market cartridge cases having a tube of plastic material and an external rear member lined with metallic pieces of tin or other similar materials, with U.S. Pat. No. 3,246,603, German Patent Specification No. P 19 60 355.5 and others which relate to cases having metal reinforced exteriors. Such prior art cartridge cases, however, constitute a source of oxidation problems in metallic reinforced members notwithstanding the use of brass or other high quality materials, which also affects the cost thereof. When a shot is made with these prior art type cartridge cases, recalibration of the exterior dimensions of these cases is necessary to take into account the change in dimension from the previous or initial dimension suffered by the exterior of the metallic on being reloaded for a new shot.

Cartridge cases made entirely of plastic or of combined materials without any sort of metallic reinforced exterior are also known and which are free from oxidation problems and provide certain improved shooting precision characteristics, loads over others known cartridge cases, and are exemplified by cartridge cases disclosed in U.S. Pat. Nos. 3,424,089 and 4,020,763 and in United Kingdom Patent No. 1,096,658. Such known cartridge cases of plastic or combined materials are, however, somewhat restricted in practice, particularly when they are used in automatic shotguns, where the action of the cartridge retaining catch upon the bases thereof produces frequent problems. The consequence of these problems is that the weapon frequently jams because of the highest energetic impingement of the retention catch upon the exterior perimeter of the base which sometimes rips off the perimetral area, as well as because of smooth impingement of the catch which slipped on the previously mentioned perimetral area of the case.

Also, when it is necessary to reload the case in order to make new shots, the seating area of the blasting piston could undergo permanent deformation, which would require an extremely careful positioning of the above mentioned blasting piston, which did not offer complete safety as regards the possibility of gas leaking through said area at the moment of shooting.

SUMMARY OF THE INVENTION

The invention disclosed herein avoids the problems discussed above, as it constitutes a case for a cartridge, preferably without any type of metallic element in contact with the outside, or with minimum contact surfaces, which in any case eliminate all danger of oxidation, with an improvement in the conditions and characteristics of the shot, with a total absence of jammings, and with a total absence of exterior recalibration and of disadjustments of the blasting piston.

At the present moment there is a great deal of concern over the situation and problems of ecology, on bearing in mind that the cases for plastic cartridges are not biodegradable. Hunters and all users in general, after shooting a gun usually leave the empty cases at the scene of the shooting. Any type of case with a metallic exterior, after having been exposed to the environment for a certain amount of time, is oxidized and cannot be used again.

The cartridge case which is the object of the present invention, apart from having superior mechanical characteristics over those of the previous cases, which enables it to be re-used a greater number of times than the previous cases as it is completely without oxidation, even in the case of small metallic portions leaking outside which are the minimum amount of their internal elements.

Another object of the present invention is to provide an improved reinforced cartridge case structure, particularly in the perimetral area of the base and consequently on all the extraction collar, which enables it to be used on a great variety of weapons, without any problem at all.

Yet another another object of the present invention is to provide an improved cartridge case, totally reinforced, preferably one completely covered by plastic material and with an extraordinary shooting precision.

Still another object of the present invention is to provide an improved cartridge case which avoids the problem of the exterior recalibration, and which also avoids misadjustments in the positioning of the blasting piston and consequent gas leaks at the moment the shot is made, guiding the above mentioned blasting piston perfectly at any moment.

To obtain a cartridge case with such characteristics as discussed above, the cartridge case is formed with a double directed exterior plastic tube, one end of which will later receive the ensemble which forms the base of the case. This ensemble will take up a circular space at the end of the tube which will exceed the tube's diameter, with the exterior base of the base and the inside of same within the tube, at the same time a centered space will be provided for housing the piston with the fulminant.

The cartridge case assembly according to the present invention preferably is formed by an internal cylindrical piece, made of plastic or of any other material, constituting the base, having exterior diameter no smaller than that of the inside of the tube, with internal surface of the load side of any shape having an orifice running through its central portion, and an exterior surface that is quite flat. This piece is located at a certain distance away from another metallic one having three fully differentiated areas, one being eminently flat and circular established at a certain distance and parallel to the outer surface of the internal cylindrical piece, there is another central one with a hollow polygonal section which stands out from the center of same downwards and which takes up the orifice of the internal piece, and another third piece which protrudes from the circular ends of the first area, thus being gradually established until a diameter which exceeds the tube's exterior diameter is obtained, with this projection presenting a component of the side opposite to the one occupied by the tube.

As regards this point, it is noted that the tube does not establish direct contact with the internal piece, neither does the latter do so with the metallic piece and only for previous supporting aism, but the three of them are separated by free spaces, upon which the plastic mass will be applied.

On its flat portion the metallic piece presents a series of regularly distributed orifices, which cross same, in the adequate number and position. The prismatic area of same can have the following types of sections, triangular, square, hexagonal, or other configuration.

Once the three pieces have been placed in the above mentioned way, which is, tube, internal piece and metallic piece, the plastic melt will be poured in by injection which will take up the following spaces:

- the space between the internal surface of the tube and the lateral surface of the interior piece;
- the space between the metallic piece and the exterior surface of the cylindrical internal piece;
- the space between the exterior wall of the prismatic zone of the metallic piece and the central orificed portion of the interior piece;
- the space upon the tube's upper frontal part between same and the metallic piece;
- lateral space of the protuberation, with a greater diameter than same;
- the spaceover the projecture;
- the space above the circular flat area of the metallic piece;
- the space constituted by the orifices of the flat area of the metallic piece;
- the space adjacent to the interior prismatic area of the metallic piece;
- the space between the base of the prismatic area of the metallic piece and a portion of the irificed area of the internal piece.

Therefore, the plastic melt completely covers the metallic piece, and at the same time covers the entire exterior of the internal piece, the orifice of same and part of its interior. As the projection of the metallic piece has a greater diameter than that of the outside of the tube, when the plastic mass surrounds the projection completely, the two form a so-called extraction collar.

The upper free end of the projection, which is obviously circular in shape, is the point of reference for the biggest height that the welding mass will reach when solidified, and same will preferably take up a small height above the upper end. At the same time, there must not be too much weld mass thickness between the outer side of the projection and the exterior of the collar, once the latter has been shaped.

Therefore, the extraction collar will be defined, preferably by an internal metallic portion, which will be totally embraced by the plastic mass which isolates it from any exterior contact. The upper free end of the projection will pertain exactly to the actuating plant of the retention latch of the automatic shotguns, while at the lower end of the projection area it will be in relation with the actuating area of the extraction latch.

The central prismatic area of the metallic piece, made in the shape of an equilateral triangle, quadrangle, or other polygon, has the primary specific characteristic of serving as a guide for the insertion of the injection tool of the final plastic mass, and in this sense it is noted that on being the section of the prismatic area that of a regular polygon, the tool which has a circular section, undergoes physical contact during its insertion, with the internal surfaces of the prismatic area, along the vertical longitudinal axis of the surfaces, in such a way that when the latter injection is carried out, followed by the extraction of the tool, there will be some vertical lines which will not be covered by plastic material, which will serve as a guideline for the cylindrical exterior of the blasting piston, centering same perfectly at the same time. It is also foreseen that the theoretical circle inscribed in the transverse section of the prismatic area, will have a diameter somewhat less than the diameter of the blasting piston, which will bring—apart from its perfect guiding—an amount of pressure upon said blasting piston, apart from the above mentioned guiding which makes the piston unmovable. At the same time, the vertices of the section of the prismatic area will serve as a guidline for the previous positioning of the metallic piece in the central gap of the base or internal piece.

Apart from the foregoing, it is noted that the blasting piston will have other guiding areas than that mention above; even though they may be secondary, they are also of interest. These areas comprise spaces lying between the polygon of the prismatic area of the metallic piece and the piston proper and are occupied by plastic matter which at the same time presses upon the piston thus iriginating a tight closing seal which impedes gas leakage.

The orifices which are made on the internal metallic piece, will be preferably made without eliminating the resulting burr from its machining, so that apart from enabling the plastic melt which comes from the injection to flow freely, the burr also serves as an ancillary element for anchorage between the metallic piece and the melt, once same is solidified.

The thickness of the metallic piece can be any one, both of constant thickness and of variable thickness along the different areas thereof, and in any case a maximum thickness will be applied which will provide the gap in which same is to be located.

The quality of the material will be that of a steel with a sufficient amount of resistance for the objects mentioned herein with the use of other types and qualities being permissible, including the use of materials different to the metallic one.

The shape of the metallic piece under consideration will not be restricted, but can be, as may be seen, of different sections and variations of said shapes, all of them being mentioned in the invention, both alone and combined.

As regards other points, the possibility of eliminating the assembly is established, the cooperation of the internal piece, by means of the sole aid of the exterior plastic tube and of the metallic piece in the appropriate way.

Also, and in certain cases, in which a high quality case is not required for a cartridge or in certain special fields, the upper end of the projection or other areas can reach directly to the exterior through the base area, without taking the precaution of covering it with any plastic mass. In this case, the possible oxidation of said areas in contact with the outside will be limited to the surface of the above mentioned areas exclusively, with the rest of the metallic parts being free and covered from said possibility, due to which the oxidation is stopped and the case can be used again.

According to the present invention it is also possible that on using the internal surface, of the load side, of the base piece in metallic material, there is chance of lining this area with plastic injection.

BRIEF DESCRIPTION OF THE DRAWINGS

Upon referring to the drawings, the reader should recognize the following.

DETAILED DESCRIPTION OF THE INVENTION

Figure 1:
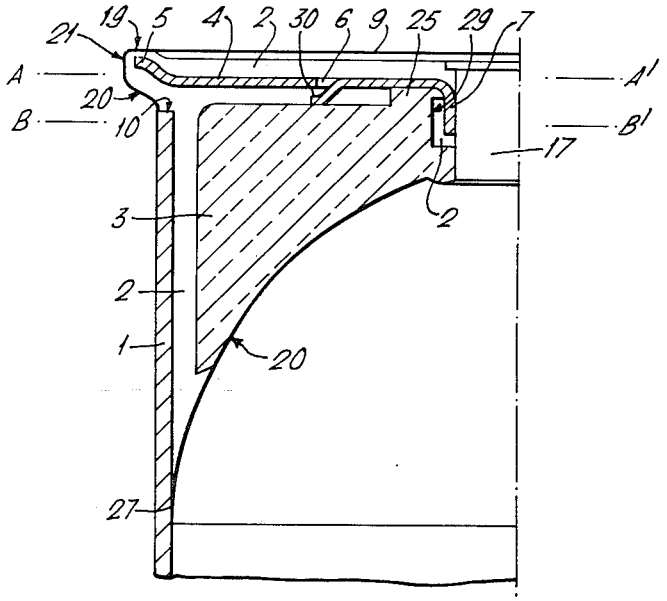
FIG. 1 is a sectional view of the object of a relevant portion of the invention.

Looking closely at FIG. 1 the reader will see that tube 1 is of plastic material, extends around an internal cylindrical piece 3 of plastic material or of any other, with a smaller diameter than the tube 1 and located at a certain distance from tube 1. This piece 3 has orifices in its central area and presents an echelon or step 22 as per description.

Figure 22:
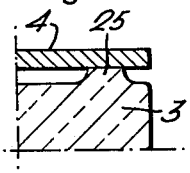
FIG. 22 is a relative appreciation of a previous supporting possibility of the metallic piece.
Figure 23:
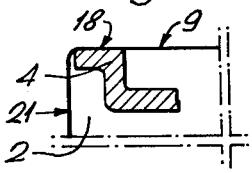
FIG. 23 shows another alternative location for the projection area.

The metallic piece 4 is located upon the internal cylindrical piece 3, positioning it in such a way that it is kept at an appropriate distance. The projection area 5 of metallic piece 4 protrudes or extends to the vertical of the exterior diameter of the tube 1, while a prismatic part 7 of metallic piece 4 is housed in gap 17, upon the echelon 22, in a stable and balanced position, for which the pertinent supports 25 or the like are provided such as in FIGS. 1 and 22.

Figure 2:
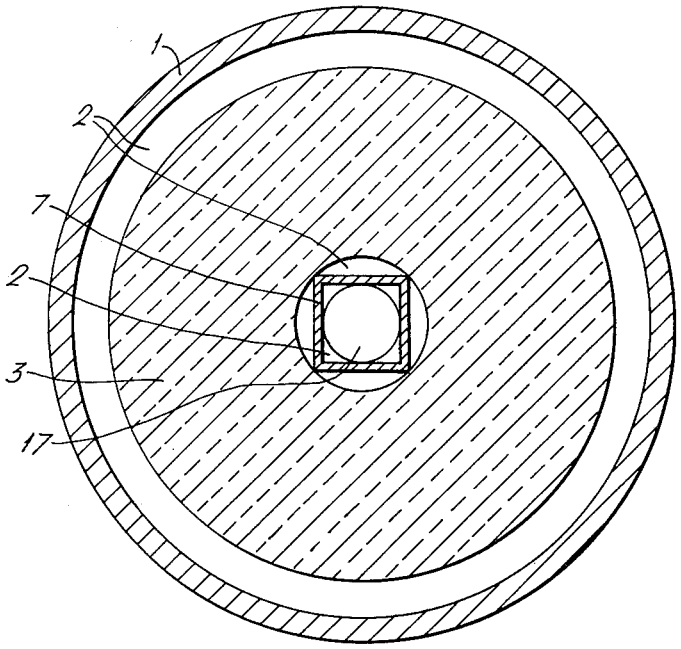
FIG. 2 shows a section AA' in FIG. 1.
Figure 3:
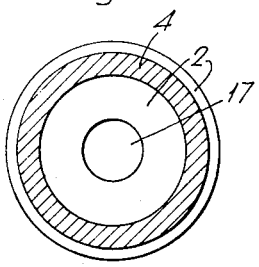
FIG. 3 is a sectional view taken through plane BB' in FIG. 1 on a reduced scale.
Figure 4:
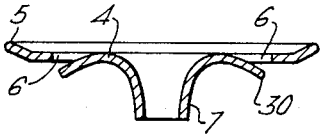
FIG. 4 is an elevational view in section of a piece of the invention on a reduced scale.
Figure 5:
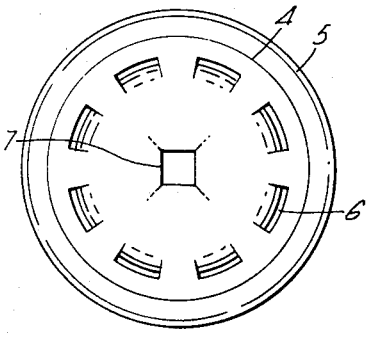
FIG. 5 shows a plan view of the piece in FIG. 4.
Figure 6:
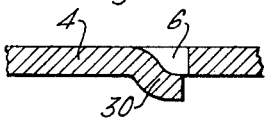
FIG. 6 is a blown-up detail of the preferred way for making the orifices of the metallic piece.

A plastic or welding mass 2 can be seen in FIGS. 1–3 and when impinging upon the layout of the assembly, takes up all the previously mentioned gaps and flows perfectly, on having readied or preformed orifices 6 on the metallic piece 4, so that there will be that normality of liquid flow which we have previously mentioned. The metallic piece 4 is completely embraced by the welding mass 2, which it gathers at the same time, as can be seen on the internal cylindrical piece 3.

The upper end of the projection 5 of the metallic piece 4 gives way to the surroundings of the case surface 9 under a circular portion 19 of the surface, thus establishing a distance taken up by the welding mass 2 between the end and the portion 19, precisely in the area where later on a retention latch of the automatic shotguns is to actuate.

Figure 7:
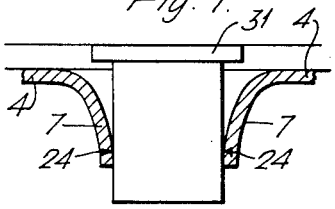
FIG. 7 is a detail relating to the re-insertion of the blasting piston into the prismatic gap of the metallic piece.

Turning to FIG. 7, the reader will see that FIG. 7 shows schematically how the housing of the blasting piston 31 is located in the hollow interior of the prismatic portion 7 of the metallic piece 4, as well as the above mentioned contact and pressure 24 points. As regards this point, and by what appears in FIGS. 2, 8 and 9, it is seen how the injection or welding mass 2 perfectly covers the interior and the exterior of portion 7 of metallic piece 4 except for small guiding points 24 for the blasting piston 31.

Figure 18:
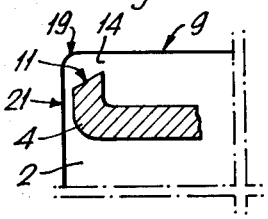
FIGS. 18, 19, 20, and 21 also disclose means by which the different shapes and positions of the face or free frontal area of the projection may be checked, as regards the free surface of the injection mass, once same has been solidified.
Figure 19:
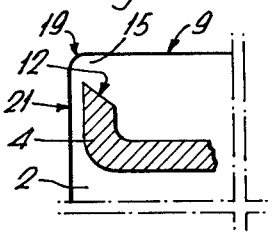
Figure 20:
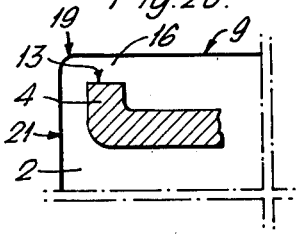
Figure 21:
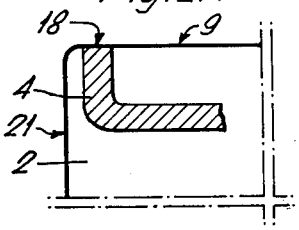

The shape of the circular surface of the upper end of the projection 5, or its location with respect to a horizontal plane, can be varied, in order to be adaptable to any type of actuation, and in this sense FIGS. 18, 19 and 20 are established. In FIG. 18, the above mentioned surface 11 is tilted upwards from left to right, observing on this figure the minimum distance 14 between the area 19 and the projection of the piece 4. On FIG. 19, the inclination sense of the surface 12 is opposite to that of surface 11 in FIG. 18, and the distance to area 19 is pointed out by line 15. Finally, on FIG. 20, surface 13 is perfectly horizontal, with a distance 16 from area 19.

All these practical realization possibilities are obviously attainable within the context of the invention, being used whenever the circumstances may deem it necessary to do so.

Another interesting aspect of the invention is that of incorporating the internal metallic piece 4 with varied shapes. These different shapes will refer to the general shaping of the metallic piece 4; this is excluding the characteristic which is common to all of them, which is that of having area 5 of projection which is precisely laid out in the above mentioned way, in the extraction collar and portions adjacent to same. As regards this point formal possibilities are arbitrated and established on FIGS. 14, 15, 16 and 17 among others.

On the first variation, the metallic piece 4 is constituted by a hoop, whose transverse section pertains to the projection and to a small horizontal parallel to the surface 9.

Figure 15:
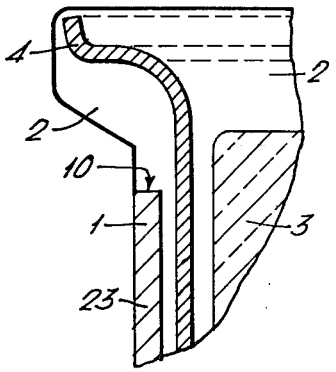

Another formal possibility appears in FIG. 15, with the metallic piece 4 presenting a lower cylindrical portion 23 which runs along the lateral space which is limited by the tube 1 and by the interior piece 3.

Figure 16:
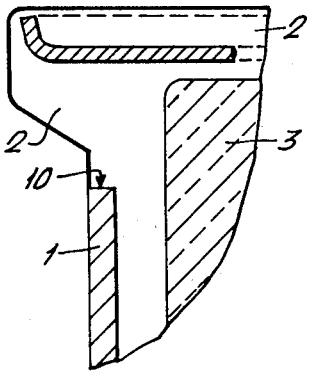
Figure 17:
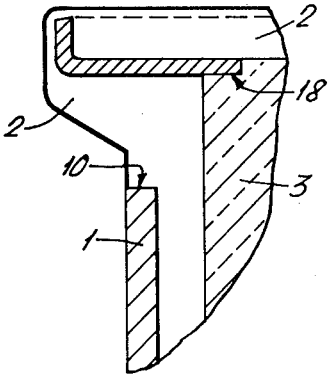

A third possibility appears in FIG. 16, with the horizontal area of the piece being interrupted over the interior piece 3, which is similar in a certain way to the one which appears on FIG. 17, on which the horizontal portion is fitted into a recess 18 of the interior piece 3.

In any case, these variations in form of various parts can be combined among themselves and with any others, in such a way that several of those described can be incorporated into one solution . . . etc., on being in all cases perfectly incorporated among themselves and with the plastic tube 1 through the welding mass 2.

Figure 13:
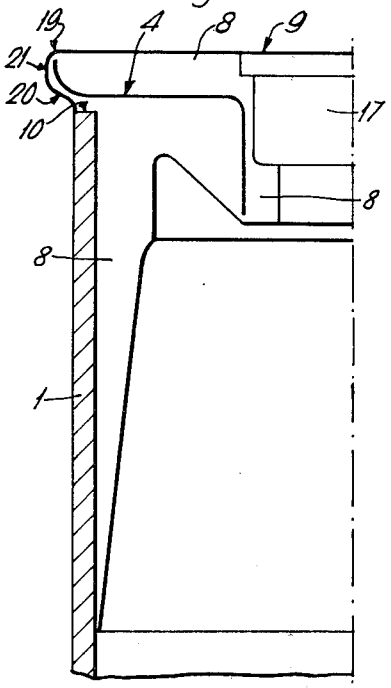
FIG. 13 pertains to another alternative embodiment within the scope of the inventive concept.
Figure 14:
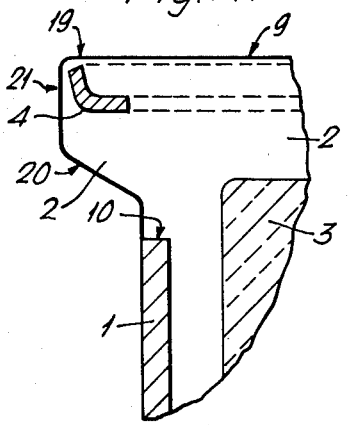
FIGS. 14, 15, 16, and 17 show various alternative forms and means of making and positioning of the metallic piece.
Figure 24:
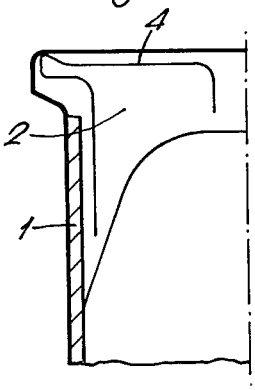
FIG. 24 shows yet another form of the case according to the invention.

As has previously been described, the invention is not exclusively concreted upon the context of FIG. 1, but it can reach other compositions, such as the one which appears on FIG. 13, in which inside the plastic tube 1 there is only one piece 4, in this case a metallic piece which can have the shape which appears herein or any other shape and whose thickness will be sufficient for enabling the injection of welding mass 8 under perfect conditions, without any risk of suck-ins . . . etc., thus being able to obtain in its manufacture a work rate or cadence sufficiently high. In this sense, and not in a limited way, same is sketched on FIG. 24.

On the other hand, and as regards the preference of using a regular prismatic shape for the shaping of portion 7 of piece 4, it maybe noted once more in FIGS. 4, 5, 11, 10 and 9, being specifically illustrated on the last, how the welding mass 2 occupies the vertices of the triangle 7 (section of the prismatic area) and leaves the vertical lines of the faces of said prismatic area free, which are represented in this section by dots 24 which guide and apply pressure upon the blasing piston which is to be inserted later on through the orifice 17 of the case.

Figure 8:
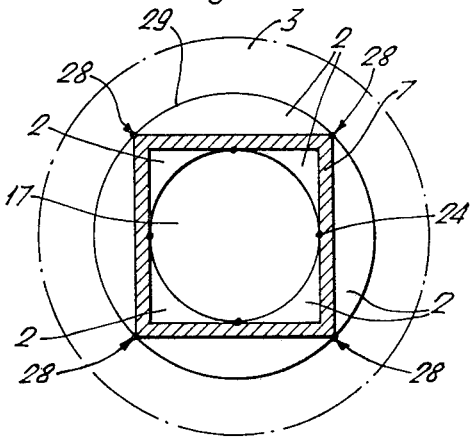
FIG. 8 is a blown-up detailed sketch of the central area of FIG. 2.
Figure 9:
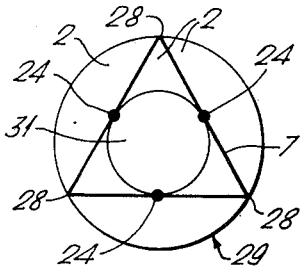
FIG. 9 is an explanatory view of the relationship of the injection tool, prismatic portion of the metallic piece and blasting piston.
Figure 10:
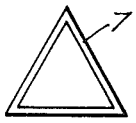
FIGS. 10 and 11 define the different sections of the prismatic area of the metallic piece.
Figure 11:
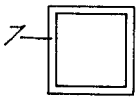
Figure 12:
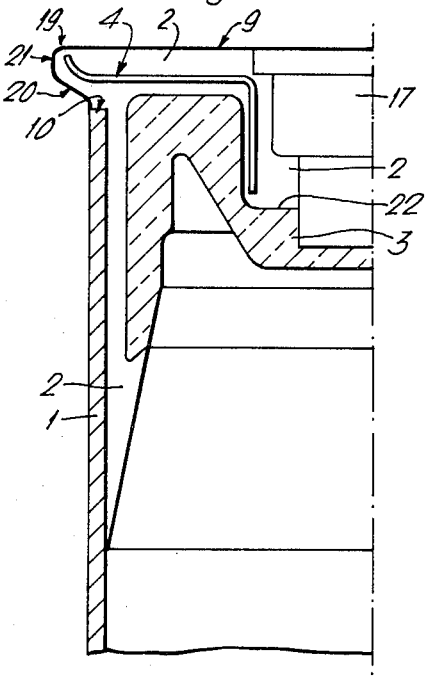
FIG. 12 is an alternative embodiment of the invention.

Similarly, it can be seen in FIG. 8 that a composition in which the exterior dots of the square section 7 are marked with 28 as guides inside the wall 29 of the internal piece or base 3 in order to favor the previous positioning of the metallic piece 4 upon piece 3, as well as the dots 24 through which the blasting piston is inserted under pressure later on.

It is to be understood that the invention is not limited to the embodiments disclosed above which are illustratively offered, and that modifications may be made without departing from the scope of the invention.

I claim:

1. An improved cartridge case comprising an external plastic tube, a metallic member located adjacent one end of said external plastic tube, an inner plastic welding mass extending within said external plastic tube adjacent one end thereof and over and beyond said one end, said metallic member including a generally flat portion with an elevated conical peripheral portion forming a blunt angle with said flat portion, said conical portion extending to a circular surface and a sharp edge, said inner plastic welding mass fully enclosing said metallic member to provide an extraction collar reinforced by said metallic member fully enclosed therein.

2. A cartridge case as defined in claim 1 wherein said metallic member includes a series of partially cut, inwardly bent tabs or rippings extending at an incline to said flat portion and impinging upon the inner plastic welding mass.

* * * * *